United States Patent [19]

Lance

[11] Patent Number: 4,942,362

[45] Date of Patent: Jul. 17, 1990

[54] APPARATUS FOR TESTING IGNITION SYSTEMS

[76] Inventor: Jeffrey Lance, 8776 Ellsworth Cir., Santee, Calif. 92071

[21] Appl. No.: 332,485

[22] Filed: Apr. 3, 1989

[51] Int. Cl.[5] ..... F02P 17/00

[52] U.S. Cl. ..... 324/402; 324/391; 324/390; 324/96

[58] Field of Search ..... 324/96, 122, 390, 395, 324/399, 402, 392, 391; 340/753, 754; 313/500; 33/783

[56] References Cited

U.S. PATENT DOCUMENTS

| | | | |
|---|---|---|---|
| 2,703,376 | 3/1955 | Board | 315/219 |
| 2,959,711 | 11/1960 | Parmater | 315/241 |
| 3,028,543 | 4/1962 | Parmater et al. | 324/399 X |
| 3,042,835 | 7/1962 | Badger | 315/241 |
| 3,369,149 | 2/1968 | Grant | 315/168 |
| 3,452,270 | 6/1969 | Cook | 324/127 |
| 3,706,032 | 12/1972 | Vikstorm | 324/127 |
| 4,005,380 | 1/1977 | Heilmann | 324/127 |
| 4,008,430 | 2/1977 | Blum | 324/402 |
| 4,241,281 | 12/1980 | Morimoto et al. | 313/500 X |
| 4,243,985 | 1/1981 | Quayle | 324/96 X |
| 4,244,108 | 1/1981 | Bailey et al. | 33/783 X |
| 4,378,525 | 3/1983 | Burdick | 324/127 |
| 4,513,246 | 4/1985 | Blain | 324/127 |

*Primary Examiner*—Reinhard J. Eisenzopf
*Assistant Examiner*—Jack B. Harvey
*Attorney, Agent, or Firm*—Andsel Group; David L. Baker; Lewis Massie

[57] ABSTRACT

An analyzation apparatus for ignition systems that has a pulse detector circuit that generates and converts an AC signal into a DC signal, filters unwanted signals and allows the user to adjust the amplitude of the signal to accommodate differing ignition systems. A pulse stretching circuit is included to increase the duration of the signal and an analog driver circuit is included to convert the signal received by it to a linear voltage suitable for driving two LED display circuits. The LED circuits are connected in parallel with the driver circuit and the visual display of the LED circuits show a display proportional to the amplitude of the signal received from the driver circuit. The LED displays show the amplitude of the signal. The LED circuits have diodes the prevent current flow between adjacent LED's of the adjacent LED circuits. The apparatus includes a function switch to select the LED circuit desired and to interrupt power to the apparatus. A portion of the elements are enclosed in a case. There are power leads to provide power to the apparatus. The apparatus may include a timing light circuit, a triggering switch and a strobe.

3 Claims, 2 Drawing Sheets

APPARATUS FOR TESTING IGNITION SYSTEMS

BACKGROUND OF THE INVENTION

1. Field of the Invention

Ignition analyzers or testers using measurements or displays derived from the induced voltage detected by a non-intrusive inductive pick-up pulse detector placed in the proximity of the wire lead from the automotive ignition coil through the distributor and into the spark plug are old in the art. The improvements claimed in issued patents are based upon methods for recording and displaying information derived from the detected pulse. The amplitude and wave form of the detected pulse can vary with the electrical load exhibited by the spark plug circuit.

2. Description of the Prior Art

Devices for non-intrusive detection and measurement of the current flow in a conductor are disclosed in the following U.S. Pat. Nos.: 3,706,032 1972 Vikstrom; 4,378,525 1903 Burdick; 4,513,246 1985 Blain. The U.S. Pat. No. 3,452,270 issued to W. J. Cook describes a device for determining the operating conditions of a combustion engine spark plug by inductively detecting the current pulse in the spark plug lead wire by the intensity of a neon light bulb illuminated by the current pulse.

SUMMARY OF THE INVENTION

The present invention employs a conventional inductive pulse detecting device which is placed in the magnetic field surrounding the pulse conducting wire or device. The sinusoidal pulse is rectified in the pulse detecting circuit and the output is shunted by a noise suppressing capacitor. The signal amplitude adjusted by a voltage attenuator is then fed into a standard integrated voltage comparator circuit which senses an analog voltage level suitable for display on conventional 10 bar graph LED displays. Two complimentary LED display bar graphs are provided. The second bar graph being mounted adjacent to the first. Means for selecting the bar graph for display is provided by a switch.

In use the pulse detector is placed in proximity of the conductor carrying the pulse to be analyzed, the signal amplitude adjusted by the attenuator, the pulse with the length increase by the pulse stretching circuit is then converted to an analog voltage for suitable display on the bar graph.

An analyzation apparatus for ignition systems has a first circuit that has a pulse detector circuit with a non-intrusive induction type pick-up pulse detector generating an AC signal proportional to magnetic field variations caused by pulsating current flowing through an ignition circuit wire. There is a diode rectifier in the pulse detector circuit to convert the AC signal to a pulsating DC signal and there is a first capacitor across a first lead and a second lead of the pulse detector circuit to eliminate unwanted signals. Included is an attenuator in the pulse detector across the second lead and a ground lead to control the amplitude of the signal from the first diode rectifier.

There is a pulse stretching circuit in the first circuit that has a second diode, a third diode and a second capacitor connected to the first lead and to the ground lead to increase the duration of the signal from the first diode rectifier. There is an LED analog driver circuit in the first circuit that senses the signal from the pulse stretching circuit and converts the signal into a linear voltage. There are two LED display circuits in the first circuit to provide a visual display proportional to the amplitude of the signal received from the driver circuit and they are connected in parallel to the driver circuit. There are a plurality of fourth diodes placed between the LED circuits to prevent current flow from passing from an LED of one of the LED circuits to an adjacent LED of another LED circuit and illuminating the LED of the adjacent LED circuit. The two LED displays visually show two functions, output and condition. See FIG. 3. The output function shows an increase proportional to an increase in signal received from the ignition system being tested or analyzed. In ignition testing, it is known that as the efficiency of ignition wires and certain other parts of the ignition lessen, more power is required to produce a spark. The coil must provide this increase. This analyzer apparatus displays this efficiency in the condition LED display by a change in the amplitude of the signal received from the LED driver circuit as shown in FIG. 3.

There is a function selector switch in the first circuit connected between the ground lead and selectively to one of the LED circuits to selectively direct current to one of the LED circuits and to interrupt current flow to the LED circuits. Power leads are included that are connected to the first circuit to provide power to the first circuit from a power source.

The analyzation apparatus has an enclosure means to house portions of the first circuit. The analyzation apparatus may have a timing light circuit, a triggering switch connected to the timing light circuit and a strobe connected to the timing light circuit.

DETAILED DESCRIPTION OF THE PREFERRED EMBODIMENT

Figure 1:
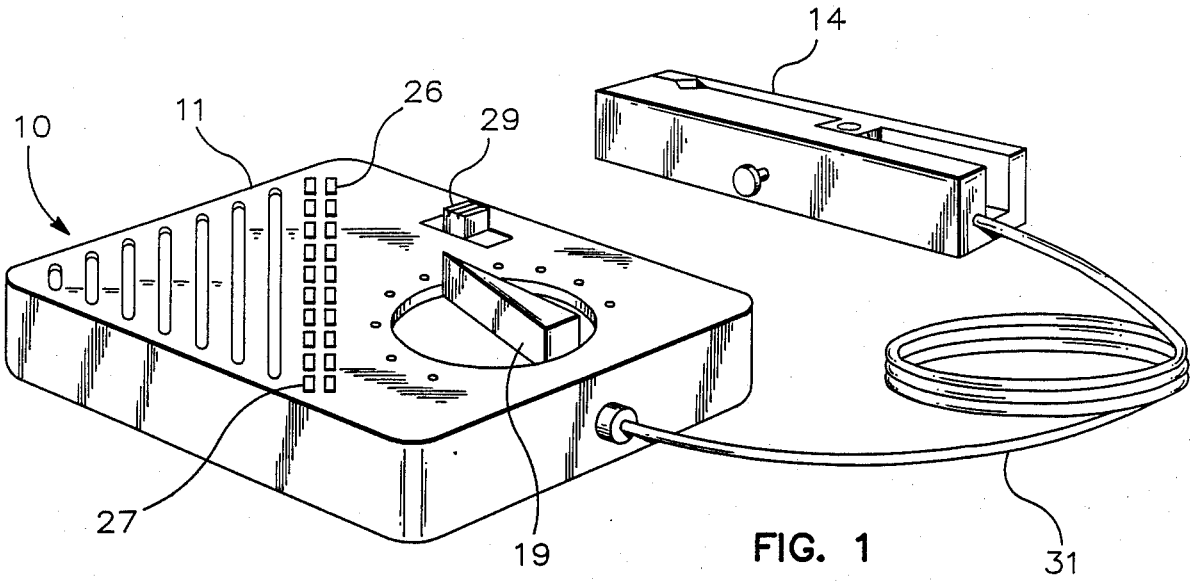
FIG. 1 is a top left perspective view of the ignition analyzer assembly.
Figure 2:
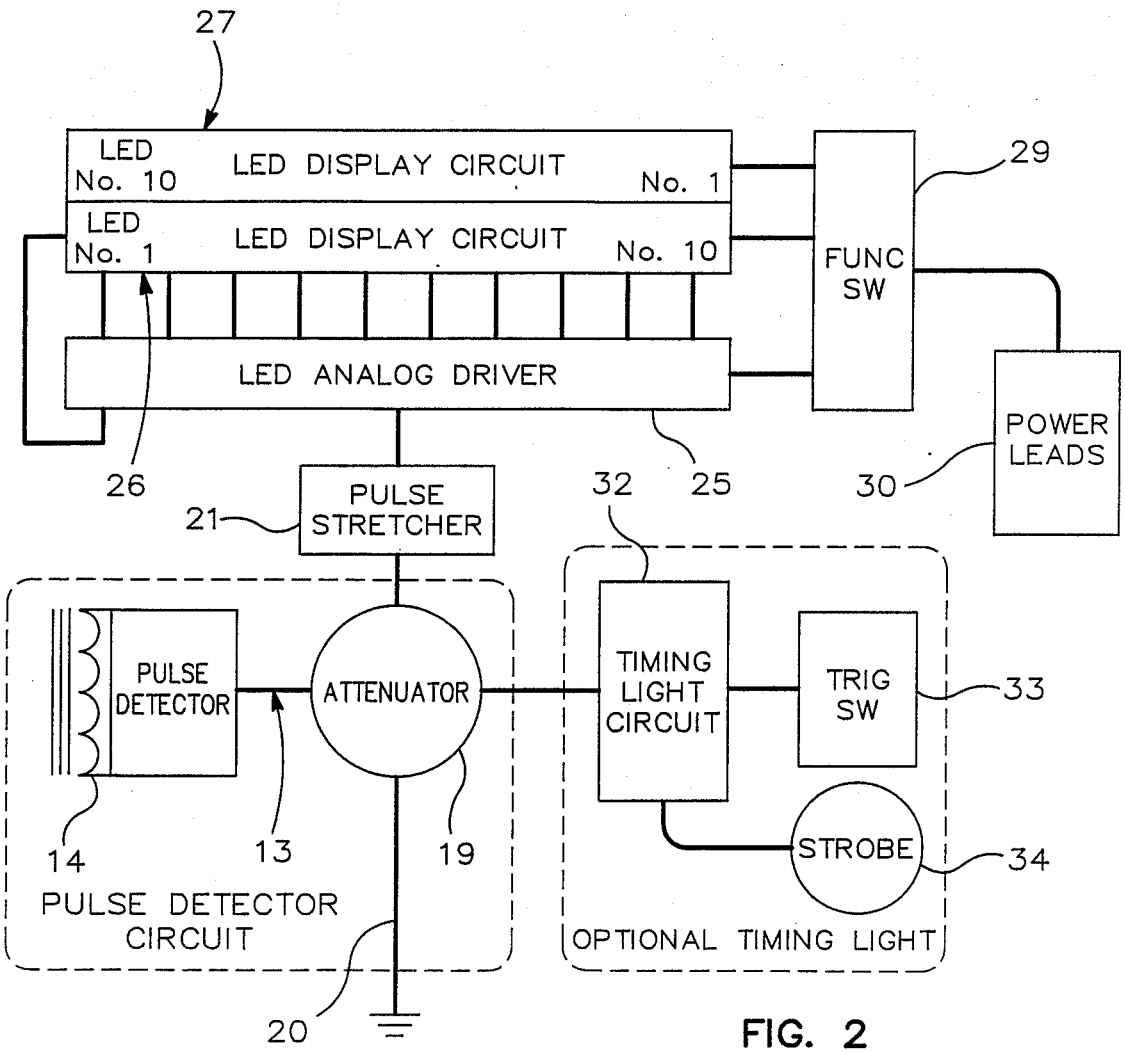
FIG. 2 is a block diagram of the ignition analyzer components.
Figure 3:
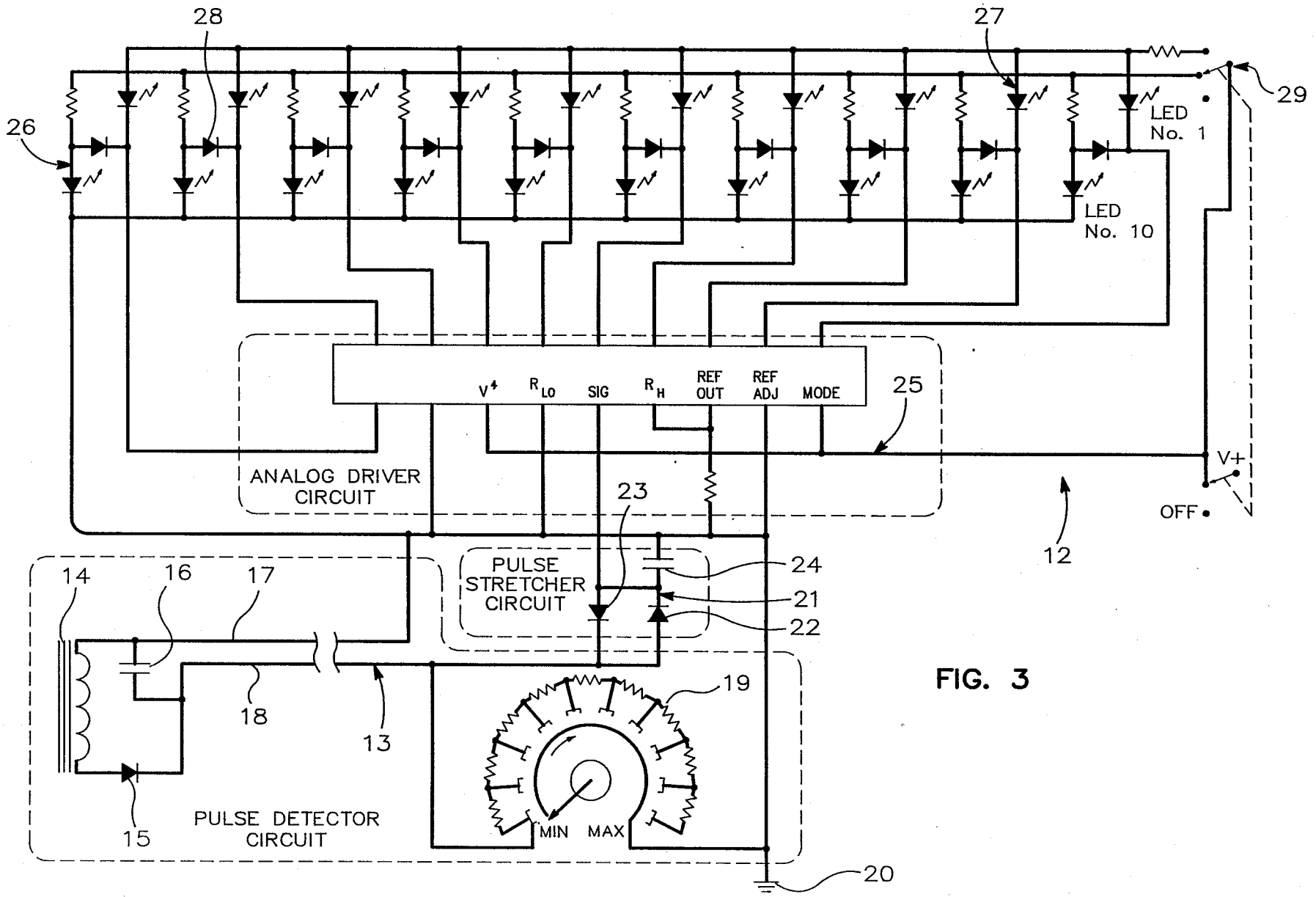
FIG. 3 is a schematic wiring diagram of the ignition analyzer.

The analyzation apparatus 10 is shown in FIGS. 1, 2 and 3. FIG. 1 shows an generalized view of the apparatus. FIG. 1 shows a case 11 with two LED displays 26 and 27, a attenuator 19 and a function switch 29. Connected to enclosure means 11 or case 11 is cable sheath 31. Cable sheath 31 contains a portion of first and second lead 17 and 18.

There is a first circuit 12 shown in FIG. 3 that has a pulse detector circuit 13 (shown enclosed in dashed lines). The pulse detector circuit 13 has a non-intrusive induction type pick-up pulse detector 14 that generates an AC signal proportional to magnetic field variations caused by pulsating current flowing through an ignition circuit wire (not shown). There is a first diode rectifier 15 in the pulse detector circuit 13 to convert the AC signal to a pulsating DC signal. Also included in the pulse detector circuit 13 is a first capacitor 16 that is connected across the first lead 17 and the second lead 18 to eliminate unwanted signals. An attenuator 19 in the pulse detector circuit 13 is connected across the second lead 18 and a ground lead 20 to control the amplitude of the signal from the first diode rectifier 15.

There is a pulse stretching circuit 21 in the first circuit 12 that has a second diode 22, a third diode 23 and a second capacitor 24 connected to the first lead 17 and to the ground lead 20 to increase the duration of the signal from the first diode rectifier 15.

There is an LED analog driver circuit 25 in the first circuit 12 that senses the signal from the pulse stretching circuit 21 and converts the signal into a linear voltage. There are two LED display circuits in the first circuit 12, FIG. 3 shows LED circuits 26 and 27, to provide a visual display proportional to the amplitude of the signal received from the driver circuit 25. The two LED display circuits 26 and 27 are connected in parallel to the driver circuit 25. There are a plurality of fourth diodes 28 placed between the LED circuits to prevent current flow from passing from an LED of LED display circuit 26 to an LED of LED display circuit 27 or the reverse and illuminating an LED of LED display circuit 26 or 27 when not desired.

There is a function selector switch 29 in the first circuit 12 connected between the analog driver circuit 25 and selectively to one LED display circuit 26 or 27 or to interrupt current flow to the LED display circuits. There are power leads 30 (shown in FIG. 2) connected to first circuit 12 to provide power to the first circuit from a power source (not shown).

FIG. 2 shows an optional timing light that has a timing light circuit 32, a triggering switch 33 connected to the timing light circuit 32 and a strobe 34 connected to the timing light circuit. The timing light circuit 32, the triggering switch 33, the strobe 34 and a portion of the first circuit may be contained in a housing (not shown) of the timing light.

I claim:

1. An analyzation apparatus for ignition systems comprising:

a. a first circuit having a pulse detector circuit with a non-intrusive induction type pick-up pulse detector generating an AC signal proportional to magnetic field variations caused by pulsating current flowing through an ignition circuit wire;

b. a first diode rectifier in the pulse detector circuit to convert the AC signal to a pulsating DC signal;

c. a first capacitor across a first lead and a second lead of the pulse detector circuit to eliminate unwanted signal noise;

d. an attenuator in the pulse detector circuit across the second lead and a ground lead to control an amplitude of the signal from the first diode rectifier;

e. a pulse stretching circuit in the first circuit having a second diode, a third diode and a second capacitor connected to the first lead and to the ground lead to increase the duration of the signal from the first diode rectifier;

f. an LED analog driver circuit in the first circuit that senses the signal from the pulse stretching circuit and converts the signal into a linear voltage;

g. two LED display circuits in the first circuit to provide a visual display proportional to the amplitude of the signal received from the driver circuit and connected in parallel to the driver circuit;

h. a plurality of fourth diodes placed between the LED circuits to prevent current flow from passing from an LED of one of the LED circuits to an adjacent LED of another LED circuit and illuminating the LED of the adjacent LED circuit;

i. a function selector switch in the first circuit connected between the LED analog driver circuit and selectively to one of the LED circuits to selectively direct current to one of the LED circuits and to interrupt current flow to the LED circuits; and j. power leads connected to the first circuit to provide power to the first circuit from a power source.

2. An analyzation apparatus as defined in claim 1 further comprising an enclosure means to house portions of the first circuit.

3. An analyzation apparatus as defined in claim 1 wherein the first circuit further comprises:

a. a timing light circuit;

b. a triggering switch connected to the timing light circuit; and c. a strobe connected to the timing light circuit.

* * * * *